United States Patent [19]

Long

[11] 3,998,944

[45] Dec. 21, 1976

[54] FUNGICIDAL PAPER

[75] Inventor: William Joseph Long, Chicago, Ill.

[73] Assignee: United States Gypsum Company, Chicago, Ill.

[22] Filed: May 8, 1974

[21] Appl. No.: 468,613

Related U.S. Application Data

[62] Division of Ser. No. 280,629, Aug. 17, 1972, abandoned.

[52] U.S. Cl. ..... 424/29; 424/258; 424/287; 424/294; 428/907

[51] Int. Cl.[2] ..... D21H 5/22

[58] Field of Search ..... 424/29, 258, 287, 294; 428/907; 106/15 R; 260/209 R

[56] References Cited

UNITED STATES PATENTS

| | | | |
|---|---|---|---|
| 2,457,025 | 12/1948 | Benignus | 428/907 X |
| 2,594,384 | 4/1952 | Benignus | 428/907 X |
| 2,765,255 | 10/1956 | Swarbrick | 424/294 |
| 3,232,929 | 1/1966 | McNeely | 260/209 R |
| 3,410,678 | 11/1968 | Ratledge | 424/294 |
| 3,705,938 | 12/1972 | Hyman | 424/19 |
| 3,720,767 | 3/1973 | Ohmori | 424/294 |

OTHER PUBLICATIONS

Amer. Prof. Pham., vol. 7, May 1941, pp. 296–297.

*Primary Examiner*—Albert T. Meyers
*Assistant Examiner*—A. Fagelson
*Attorney, Agent, or Firm*—Samuel Kurlandsky; Donnie Rudd; Robert H. Robinson

[57] ABSTRACT

Paper sheets, such as for use as the cover sheet of gypsum wallboard and the like, are rendered mildew-resistant by adding to the paper at the calender stack rolls an aqueous dispersion containing a heavy metal salt of quinolinolate, a paper coating binder and a colloidal suspending agent. A particularly preferred aqueous dispersion contains about 5–40% of a 30% active copper-8-quinolinolate paste concentrate; about 3–30% of a wax binder, preferably about 5–60% of an about 50% active wax emulsion such as of PARACOL 404 R; and a small amount of a generally non-thickening colloidal suspending agent preferably a xanthan gum.

4 Claims, No Drawings

FUNGICIDAL PAPER

This is a divisional of application Ser. No. 280,629, filed Aug. 17. 1972. now abandoned.

BACKGROUND OF THE INVENTION

This invention concerns a fungicidal formulation and mildew-resistant paper; and more particularly a method for forming a mildew-resistant paper suitable for subsequent uses involving heat and moisture, and without involving quantities of hazardous solvents.

There are numerous problems presented in prior attempts to provide a satisfactory fungicidal cellulosic fiber mat, such as paper or multi-ply board for uses wherein the mat will be subjected to subsequent heat and humidity, for example when using the paper for the cover sheet of gypsum wallboard or in the formation of wallpaper and the like. In the formation and curing of gypsum wallboard, a slurry of gypsum and other materials is formed and, while wet prior to setting, is covered with paper facing sheets. Then when the gypsum is set, the combination is dried by heat and in the presence of considerable moisture. The cover sheets must be able to withstand the subsequent heat and moisture treatment without allowing the fungicide to become fugitive, that is vaporized or sublimated into the atmosphere. In addition, the paper sheets for such usage must be fungicidal without in any way interfering with the sizing activity.

There have been two basic prior approaches to incorporating a fungicide, in insoluble powdered or particulate form, into paper for such usage as in wallboard cover sheets; namely an interior or integral treatment method to the pump slurry during formation of the paper sheets, and a surface treatment method to the already formed paper. In the former method, which is currently the most commercially used method, the fungicide toxicant is added directly to the pulp slurry and, as a consequence, excessive amounts of fungicide are required to compensate for toxicant loss by fugitivity or sublimation on the paper machines and the board machines, plus water pollution is unavoidable due to fungicide wasted and lost in the waste water effluent system. In the latter application, if the fungicide is applied as an aqueous dispersion to normally sized paper, the fungicide generally adversely affects the paper sizing and almost doubles the normal quantity of sizing required. Further, there is a high degree of fungicide material loss due to "dusting" or fall-out at the paper mill rewinder, during shipping and handling, and once the paper has been formed in a final product mounted on walls or ceilings.

In addition most water base powder, paste or dispersion applications produce a vry uneven surface treatment. A very important criterion for surface treatment of the paper is that the fungicide deposited must uniformly and completely cover the paper surface. If there is any "spottiness" or non-uniform application of the fungicide material to the paper, a potential site for fungus growth is created. The treatment of paper which allows any such potential sites for fungus growth is really worse than no treatment of the pape at all, since additional time, chemicals, money, and processing have been put into the paper without achieving the desired result.

Many fungicides are available in soluble forms in solvent solutions or solvent emulsions; but these are unsuitable since evaporation of solvent creates both a fire and health hazard and any solvent remaining at the time the paper is applied to its intended usage, such as in gypsum paper and wallboard formation, adds health and fire hazards at that time.

A family of generally highly effective fungicides are the water-insoluble metal quinolinolate salts. The metal reactant to form the salt may be an alkaline earth metal, a heavy metal salt, or aluminum, tin or beryllium. Examples of suitable of such salts are the calcium, barium, magnesium, beryllium, lead, mercury, manganese, copper, nickel, iron, cadmium, silver, thallium, tin, zinc and aluminum salts of 2-hydroxyquinoline, 4-methyl-2-hydroxyquinoline, 4-hydroxyquinoline, 2-methyl-4-hydroxyquinoline; 5-hydroxyquinoline; 6-hydroxyquinoline; 7-hydroxyquinoline and 8-hydroxyquinoline. The preferred compounds for use in the present invention are the salts of 8-hydroxyquinoline; and particularly the copper-8-quinolinolate compound because it is commercially available and provides superior fungicidial and/or fungistatic properties. Copper-8-quinolinolate is a chelated copper organic salt having the following molecular structure:

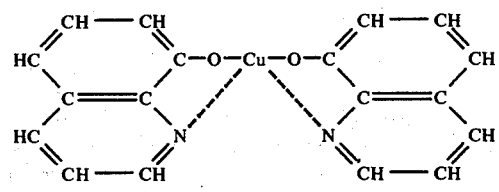

It is an odorless, amorphous fluffy green non-ionizable powder having a high degree of chemical stability and generally characterized by its low water and common organic solvent insolubility. Copper-8-quinolinolate has been solubilized with various organic materials such as set forth in U.S. Pat. Nos. 3,561,380; 2,608,556; 2,769,006; and 2,561,379. Copper-8-quinolinolate solubilized by these processes has compounded a material suitable for dilution with aromatic or aliphatic solvents for solvent applications to materials.

A paste emulsion concentrate of copper-8-quinolinolate has been propounded which may be thinned to use dilutions with water; however, the insoluble copper quickly settles out of the water dilutions. This paste emulsion suffers the detriments attributed to the unsolubilized copper-8-quinolinolate with regard to coating papers such as wallboard cover sheets. Hence, water dilutions of the paste emulsion concentrate, when applied to wallboard paper cover sheets by surface application result in uneven coverage and a speckled appearance due to spaces remaining between the particles of copper-8-quinolinolate, which spaces are susceptible to fungus attack; and only the surface immediately in contact with the copper-8-quinolinolate particles is protected. Further the copper-8-quinolinolate particles tend to "dust" out of the paper.

SUMMARY OF THE INVENTION

It is therefore one object and advantage of the present invention to provide fungicidal paper sheets, such as for use as the cover sheets of gypsum wallboard and the like.

Another object is the provision of fungicidal paper sheets, wherein the paper has a surface coating of uniformly applied highly active fungicide.

A further object is the provision of surface treated fungicidal paper wherein the fungicide is not subject to fugitivity and does not adversely affect the paper sizing.

Another object is the provision of a surface treated fungicidal paper wherein the fungicidal powder or particles are not subject to dusting at the paper mill rewinder nor lost through fall-out when the paper is converted into wallboard cover sheet.

Still another object is the provision of a process for surface treatment of paper suitable for subsequent uses involving heat and moisture with a fungicide, and uniformly and thoroughly coating the paper with the fungicide without involving the use of hazardous solvents.

A further object is the provision of a process which avoids hazardous fungicides or their solvents in the paper still effluent system thereby avoiding a source of water pollution at the paper mill.

A still further object is the provision of a process for the surface application of a fungicide to a paper sheet suitable for subsequent uses involving heat and moisture whereby a granulated or powdered, insoluble quinolinolate fungicide is uniformly applied to the paper sheet without the use of large quantities of hazardous solvents.

The fulfillment of these and other objects and advantages of the present invention are accomplished, in one highly specific preferred embodiment, by forming an aqueous dispersion comprising by weight about 5–40% of a 30% active copper-8-quinolinolate paste emulsion concentrate, about 3–30% solids of a binder preferably about 5–60% of an about 47% solids wax emulsion, and a small amount of a colloidal suspending agent preferably a xanthan gum, in water; adding minor yet effective amounts of the dispersion to the surface of the paper at the calender stack rolls at the dry end of the paper forming processes using the water box at a rate of pick up of about 1.5 to about 2 pounds of the dispersion per thousand feet of paper; and evaporating the water from the surface of the paper to result in encapsulating the fungicide in a binder coating upon the paper sheet.

DESCRIPTION OF THE PREFERRED EMBODIMENTS

The active fungicide ingredient is preferably a copper-8-quinolinolate for reasons of commercial availability. Copper-8-quinolinolate is commercially available as a paste emulsion concentrate, which may be thinned to use dilutions with water, under the trademark SOCCI 2444 from Ventron Corporation. This product is an about 58% solids by weight aqueous dispersion containing about 30% by weight active copper-8-quinolinolate. When this material by itself is merely thinned to use dilutions with water and applied to paper, a speckled appearance results and the fungicide tends to "dust" off. On an active weight basis the quinolinolate salt should be present in the dispersion in an amount that will provide fungicide effectiveness such as about 3% to about 30% or more, although somewhat more or less may be used but without substantial further advantage.

The binder is preferably a wax emulsion or a wax-resin emulsion; and a highly preferred wax emulsion is one containing about 47% solids on a weight basis of a fully refined paraffin wax, such as that commercially available under the trademark PAROCOL 404R. However, any mineral wax of paraffin or petroleum derivation or any synthetic wax may be used. In addition, wax-resin binders may be used wherein the resin is for example a modified rosin such as terpene or tall oil and the like. Further resin emulsions based on acrylics, styrene, butadiene-styrene and the like may be used; as well as various synthetic latices such as polyethylene latices, butadiene-styrene latices, butadiene-acrylonitrile latices, and the like as are well known in the trade. Such binders are more particularly set forth in *Synthetic and Protein Adhesives for Paper Coating*, TAPPI Monograph Series No. 22, published in 1961 by the Technical Association of the Pulp and Paper Industry. Starches and other cellulosic binders, generally used as binding material in paper coatings, are not recommended as a binder in the present invention since such materials actually appear to feed the fungus growth. Thus the binder in the present dispersions may generally be considered as one selected from the group consisting of wax emulsions, wax-resin emulsions, resin emulsions and synthetic latices. Any particular binder and its concentration for use in the present invention will be readily determined by merely mixing it together with use concentrations of the metal quinolinolate salt and the binder. The dispersion will immediately break if they are incompatible and the binder is not suitable for use in the present dispersion. The amount of the binder on an active weight basis is highly variable and not particularly critical, and may vary from about 2 to about 40%.

The dispersion is held together without settling by the inclusion of small amounts of a colloidal type of suspending agent; and generally any one of those which will suspend aqueous systems without substantially thickening or changing the viscosity of the dispersion to substantially greater than 300 centipoises are preferred. Desirably, the colloidal agent selected will not change the viscosity of the system or else it will slightly increase the viscosity of the system. A highly preferred colloidal suspending agent to form a stable dispersion in accordance with the present invention is xanthan gum, which is a high molecular weight linear polysaccharide, such as that commercially available under the trademark KELZAN. Generally, amounts of this colloidal suspending agent of less than about 0.3% to about 1% by weight are satisfactory; and preferably the amount is in the range of about 0.1–0.3%, and more particularly about 0.15% for preferred compositions. The amount of the colloidal suspending agent to be used will vary depending on the amount of binder and copper quinolinolate concentrations in the dispersion. Somewhat more or less than given above may be used but without substantial further apparent advantage. Other colloidal suspending agents such as carboxymethylcellulose, methylcellulose, and the alginates such as Kelgin sodium alginate may be used, especially where their quantity is toward the lower portion of the range set forth herein, since they tend to thicken the dispersion.

The following examples are presented for the purpose of further illustrating and disclosing the invention, and are in no way to be construed as limitations thereon.

EXAMPLE 1

An aqueous fungicidal dispersion according to the invention was compounded to contain about 49.5% of water with about 20% by weight of about 30% active insoluble copper-8-quinolinolate paste emulsion (SOCCI 2444) in conjunction with about 30% by weight of an aqueous emulsion of fully refined paraffin wax containing 47% solids and emulsified with a casein emulsifier (PARACOL 404 R) as the binder and about 0.15% of xanthan gum colloidal suspending agent (KELZAN M). The copper-8-quinolinolate starting material was in the form of a thick paste. The above formulated dispersion of the invention presented, upon standing, a stable, uniform, aqueous dispersion which would not settle out or separate over an indefinite period of time.

When the thick quinolinolate paste was thinned out with water alone, and with water and the wax alone, and aliquots deposited upon Manilla paper stock of 75 lb. or 16 point character. It was observed that the paper presented a spotted appearance after drying of the water indicating a non-uniform depositing of the copper fungicide. Further the water dilutions did not hold the copper salt and it rapidly settled out.

When aliquots of the quinolinolate paste were thinned with water to which had been added the xanthan gum without a binder such as the wax above and then applied to the paper sheets, the fungicide appeared powdery on the sheet, dusted off readily, and fungicidal activity simply was not effectively retained.

When aliquots of the dispersion of the invention were deposited upon paper, and allowed to dry, the paper presented a uniformly yellow-green colored appearance, and microscopic examination did not show any non-uniformity in depositing the copper fungicide. Also when this formulation was applied to the paper sheets, no dusting occurred at the paper mill rewinder; and when the paper was used for gypsum wallboard, no dusting or fall-out was noted on the board.

EXAMPLE 2

The dispersion of the invention set forth in Example 1 was applied to the surface of regular 60 pounds per thousand square feet weight or 16 point Manilla paper, in a full scale paper plant run, at the water box located on the paper mill calender wet stack. The dispersion remained stable in the starch box at all times and no difficulties were experienced during the run. The treated paper presented the appearance of a uniform pastel yellow color, and no apparent changes were detected in the porosity or strength properties of the treated paper or in the quantities of sizing required for the paper. The water resistance of the treated paper was reduced from 1.2 grams to 0.4 grams, using a 3 minute and 90° F water Cobb test.

The treated paper from the paper mill run and an untreated sample made at the same time were evaluated for mildew resistance and copper determination. The results are as follows:

| Copper Determination | % Cu | % Cu-8-quinolinolate |
|---|---|---|
| Treated paper | 0.012 | 0.066 |
| Untreated paper | — | — |
| | Mg. of Cu per square foot | Mg. of Cu-8-quinolinolate per sq. ft. |
| Treated paper | 2.8 | 15 |
| Untreated paper | — | — |

Mildew Resistance - After 10 days incubation with A. oryzae

| | Zone of Inhibition in millimeters | Growth Appearance |
|---|---|---|
| Treated paper | 1 | no growth |
| Untreated paper | 0 | heavy growth |

The treated paper was then used as the face cover sheet in formation of gypsum wallboard. The resultant wallboard was made without any difficulties in adhering the cover sheet to the gypsum. There were no problems of blown paper covers. There was no need to add additional sizing agents in comparison to a comparative run using untreated paper.

The treated paper wallboard was submitted to a long term aging test and exposure to mildew. After three weeks, mildew effectiveness had not been lost in the treated paper.

While the present invention has been described and exemplified with respect to certain embodiments, it is not to be considered limited thereto; and it is understood that variations and modifications thereof, obvious to those skilled in the art, may be made without departing from the spirit or scope of the invention.

What is claimed is:

1. A fungicidal porous paper cover sheet for gypsum wallboard having a uniform surface coating of metal quinolinolate in a binder, which coating provides uniform surface fungistatic properties, where the coating results from coating the paper cover sheet with a stable aqueous dispersion consisting essentially of 3–30%, on a fungicidal active weight basis, of a metal salt of a hydroxyquinoline, 3–30% solids of a binder selected from the group consisting of a wax, rosin, acrylic resins, styrene, butadiene-styrene, butadiene-acrylonitrile and polyethylene resins each in the form of an emulsion, a minor amount of a colloidal suspending agent selected from the group consisting of xanthan gum, methylcellulose, carboxymethylcellulose, and an alginate, said amount being an amount sufficient to prevent settling, while providing a dispersion viscosity not substantially greater than 300 centipoises and evaporating the water.

2. The paper cover sheet of claim 1 in which the hydroxyquinoline salt is copper-8-hydroxyquinoline.

3. The paper cover sheet of claim 1 where the colloidal suspending agent is xanthan gum.

4. The paper cover sheet of claim 3 where the xanthan gum is present in an amount of about 0.1 to about 1% by weight of the aqueous dispersion.

* * * * *